US008197028B2

(12) United States Patent
Nakata

(10) Patent No.: US 8,197,028 B2
(45) Date of Patent: Jun. 12, 2012

(54) LIQUID DISCHARGING APPARATUS

(75) Inventor: Satoshi Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 625 days.

(21) Appl. No.: 12/357,993

(22) Filed: Jan. 22, 2009

(65) Prior Publication Data

US 2009/0189948 A1 Jul. 30, 2009

(30) Foreign Application Priority Data

Jan. 24, 2008 (JP) ..... 2008-014257
Jan. 24, 2008 (JP) ..... 2008-014260
Jan. 24, 2008 (JP) ..... 2008-014261
Oct. 10, 2008 (JP) ..... 2008-264003

(51) Int. Cl.
*B41J 23/00* (2006.01)

(52) U.S. Cl. ..... 347/37; 347/39

(58) Field of Classification Search ..... 347/37–39
See application file for complete search history.

(56) References Cited

U.S. PATENT DOCUMENTS 5,126,754 A * 6/1992 Spinar et al. ..... 346/29

FOREIGN PATENT DOCUMENTS

| | | | |
|---|---|---|---|
| JP | 06-061084 | | 3/1994 |
| JP | 06-071889 | | 3/1994 |
| JP | 2001-129983 | | 5/2001 |
| JP | 2004-148180 | | 5/2004 |
| JP | 2002-376366 | * | 7/2004 |
| JP | 2004-202939 | | 7/2004 |
| JP | 2004-268337 | | 9/2004 |
| JP | 2004-284209 | | 10/2004 |
| JP | 2005-081713 | | 3/2005 |
| JP | 2006-096028 | | 4/2006 |
| JP | 2007-276264 | | 10/2007 |
| WO | 03/074277 | | 9/2003 |

* cited by examiner

*Primary Examiner* — Geoffrey Mruk
(74) *Attorney, Agent, or Firm* — Workman Nydegger

(57) ABSTRACT

A liquid discharging apparatus according to a first aspect of the invention includes a liquid discharging head configured to discharge liquid from nozzles in a discharged material transported in a first direction; a carriage configured to mount the liquid discharging head and reciprocate in a second direction which intersects the first direction; and a carriage moving unit configured to reciprocate the carriage, and the carriage moving unit includes a first drive unit and a second drive unit operating independently from each other, and a first supporting portion of the first drive unit with respect to the carriage and a second supporting portion of the second driving unit with respect to the carriage are located at positions displaced in the first direction.

8 Claims, 12 Drawing Sheets

$$S = x \cdot \frac{Le}{Ln \cdot \cos\theta}$$

if $\theta << 1$ $$S \approx x \cdot \frac{Le}{Ln}$$

Vc11>Vc12>Vc13
H1<H2<H3

Vn1=Vn2=Vn3
H1=H2=H3

LIQUID DISCHARGING APPARATUS

BACKGROUND

1. Technical Field

The present invention relates to a liquid discharging apparatus including a liquid discharging head configured to discharge liquid from nozzles in a transported discharged material, a carriage configured to mount the liquid discharging head and reciprocate in the direction intersecting the transport direction of the discharged material integrally with the liquid discharging head, and a carriage moving unit configured to cause the carriage to reciprocate.

In this specification, the term "liquid discharging apparatus" includes printing apparatuses including ink jet printers (serial printer) that execute printing jobs on a printed material by discharging ink from nozzles in a printhead, facsimile machines, and multifunctional peripherals, and apparatuses configured to discharge liquid corresponding to the application thereof instead of the ink from a liquid discharging head corresponding to the printhead onto a discharged material corresponding to the printed material and cause the liquid to be attached to the discharged material.

2. Description of the Related Art

An ink jet printer as an example of the liquid discharging apparatus will be described. The ink jet printer includes a serial printer which executes a printing job while causing a carriage having a printhead mounted thereon to reciprocate in the direction interesting the direction in which a paper is transported (see JP-A-2004-284209, JP-A-2005-81713, JP-A-2004-268337, JP-A-2006-96028, and JP-A-7-61084).

The ink jet printer of this type has a problem such that vertical rule marks are inclined when printing rule marks due to various causes described below. This problem means that an image is inclined, which is becoming more remarkable as the length of nozzle rows increases.

As a first cause of the inclination of the vertical rule mark, for example, there is a structural cause such that a printhead 13 is mounted on a carriage 10 in an inclined posture as shown in FIG. 5. The printhead 13 includes nozzle rows 31 including a plurality of nozzles 30, 30, . . . arranged along a transport direction A of a paper P. The printhead 13 is supposed to be mounted in such a manner that the nozzle rows 31 extend in parallel to the transport direction A which is orthogonal to a primary scanning direction B in which the carriage 10 moves. However, when the printhead 13 is mounted on the carriage 10 in an inclined posture, the nozzle rows 31 are also inclined with respect to the transport direction A of the paper P by an angle of inclination θ.

When a rule mark M (see FIG. 7) is printed on the paper P in this state, it is printed with an inclination of a, which is the same as the inclination of the nozzle rows 31, when the carriage 10 is moved at a very low velocity as shown in FIG. 8. However, when the carriage 10 is moved outward at a normal velocity, a velocity Vc1 of the carriage 10 is added and hence the rule mark M is printed with an inclination of b, and when the carriage 10 is moved homeward, a velocity Vc2 of the carriage is added and hence the rule mark M is printed with an inclination of c, so that the ink drop positions are displaced.

Subsequently, as a second cause of the inclination of the vertical rule mark, there is a structural cause such that ink discharge velocities Vn1, Vn2, and Vn3 are different from each other due to the difference in ink discharge positions d, e, and f of the respective nozzles 30 of the nozzle rows 31 of the printhead 13 among the downstream side, the center portion, and the upstream sides thereof as shown in FIG. 9. More specifically, as shown in the drawing, it is a case where the discharge velocity Vn is gradually lowered in the transport direction A of the paper P such that the ink discharge velocity Vn1 at the position d of the nozzles 30 on the downstream side is the highest, then is lowered to the ink discharge velocity Vn2 at the position e of the nozzles 30 in the center portion, and then to the ink discharge velocity Vn3 at the position f of the nozzle 30.

In this case, when ink drop distances H1, H2, and H3 between the nozzles 30 and the paper P are all the same irrespective of the ink discharge positions d, e, and f, the ink drop which is discharged from the position d of the nozzles 30 on the downstream side where the ink discharge velocity is the highest reaches the paper P at an earliest moment. Then, the ink drops from the position e of the nozzles 30 in the center portion reach the paper P next, and then from the position f of the nozzles 30 on the upstream side. The velocity of movement of the carriage 10 in the primary scanning direction B is added thereto, so that the inclination of the vertical rule mark is resulted. This inclination occurs in the opposite direction in the outward and homeward movements of the carriage.

As a third cause of the inclination of the vertical rule mark, there is a structural cause such that the ink drop distances H1, H2, and H3 are different depending on the difference of the ink discharge positions d, e, and f within the nozzle rows 31 of the printhead 13 as shown in FIGS. 10 and 11. More specifically, even though the ink discharge velocities Vn1, Vn2, and Vn3 from the respective ink discharge positions d, e, and f are the same, when the paper P is inclined to be higher on the downstream side in the transport direction A as shown in FIG. 10, or when the printhead 13 is inclined to be lower on the downstream side in the transport direction A as shown in FIG. 11, the ink drop from the position d of the nozzles 30 on the downstream side reaches the paper P at the earliest moment, then from the position e of the nozzles 30 in the center portion the ink drops, and then from the position f of the nozzles 30 on the upstream side as in the case shown in FIG. 9. The velocity of movement of the carriage 10 in the primary scanning direction B is added thereto, so that the inclination of the vertical rule mark is resulted as in the case of the second cause.

As a fourth cause of the inclination of the vertical rule mark, there is a fact that the ink discharge velocity is influenced by the resistance of the air as shown in FIG. 12. Accordingly, an initial discharge velocity Vn11 of the discharged ink is decreased gradually as the ink drop distance increases. In other words, the ink discharge velocity will be Vn11>Vn12>Vn13. Therefore, when the ink drop distance is increased according to the difference of the ink discharge positions d, e, and f of the nozzle rows 31 as the third cause, the ink drop positions in the primary scanning direction B of the carriage 10 is displaced depending on the difference of the ink drop distance due to the influence of gradual decrease in velocity. This displacement occurs in the opposite direction in the outward and homeward movements of the carriage.

As a fifth cause of the inclination of the vertical rule mark, there is a fact that the velocity component Vc11 of the carriage 10 in the ink discharge velocity is influenced by the resistance of the air as shown in FIG. 13. Accordingly, the velocity component Vc11 of the carriage 10 in the ink discharge velocity is decreased gradually as the ink drop distance increases. For example, the velocity component on the basis of the velocity Vc1 of the carriage in the outward movement will be Vc11>Vc12>Vc13. Therefore, when the ink drop distance is increased according to the difference of the ink discharge positions d, e, and f of the nozzle rows 31 as the third cause, the ink drop positions are displaced in the primary scanning direction B of the carriage 10 depending on the difference of the ink drop distance due to the influence of gradual decrease of the velocity component. This displacement occurs in the opposite direction between the outward and homeward movements of the carriage.

As a sixth cause of the inclination of the vertical rule mark, there is an influence of the flow of air C which is generated by the reciprocal movement of the carriage 10 in the substantially sealed space in the printer body 3 as shown in FIG. 14. When the air C flows between the nozzle rows 31 and the paper P, the ink drop positions on the paper P are displaced.

As a seventh cause of the inclination of the vertical rule mark, there is a "swing" caused by a supporting point Q as a connecting point between a toothed belt 11 and the carriage 10 from being apart from the center of gravity W of the carriage 10 having the printhead 13 mounted thereon as shown in FIG. 15. Since the carriage 10 swings and inclines in different directions by the reciprocal movement of the carriage 10, displacement of the position of the ink drop on the paper P occurs according to the direction of movement of the carriage 10.

However, although a technology to correct the inclination of the paper P with respect to the primary scanning direction B of the carriage 10 by rotating the paper P is disclosed in JP-A-2004-284209, it cannot be a countermeasure for the structural cause such as the first cause of the inclination of the vertical rule mark such that the printhead 13 is mounted on the carriage 10 in the inclined posture. When the configuration as disclosed in JP-A-2004-284209 is employed, the device is upsized, and hence a large space for installing the device is required. In addition, its advantage can hardly be expected for an elongated paper P.

Although a technology to make the inclination of the nozzle rows is adjustable by pressing a side surface of the printhead 13 by a pressing member is disclosed in JP-A-2005-81713, the first cause of the inclination of the vertical rule mark cannot be addressed with high degree of reliability. It is difficult to address the remaining second to seventh causes by the pressing member. The technology disclosed in JP-A-2004-268337 enables the provision of the supporting point Q of the carriage 10 in the vicinity of the center of gravity W of the carriage 10 by inclining the printhead 13 so as to be parallel to the paper P. However, the seventh cause of the inclination of the vertical rule mark cannot be addressed with high degree of reliability. The remaining first to sixth causes cannot be addressed at all.

In the same manner, the technology disclosed in JP-A-2006-96028 restrains the inclination of the carriage 10 by applying an urging force to a carriage guide shaft by a compression spring in the direction intersecting the axial line of the carriage guide shaft at a position apart from the center of gravity W in the primary scanning direction B on a plane horizontal to the paper P. However, the seventh cause of the inclination of the vertical rule mark cannot be addressed with high degree of reliability. The remaining first to sixth causes cannot be addressed at all. In addition, since the magnitude of the urging force is needed to increase as the acceleration of the carriage 10 increases, as the weight of the carriage 10 increases, and as the distance to the center of gravity W of the carriage 10 increases, an additional load is applied when reciprocating the carriage 10.

Although a technology disclosed in JP-A-7-61084 is adapted to eliminate rattling of the carriage 10 by forming the shape of extension of the belt for reciprocating the carriage 10 into a triangle shape, the seventh cause of the inclination of the vertical rule mark cannot be addressed with high degree of reliability. The remaining first to sixth causes cannot be addressed. Since extending the belt into a triangle shape requires a large space, upsizing of the device might be resulted.

SUMMARY

An advantage of some aspects of the invention is to reduce the displacement of liquid drop positions caused by the above-described causes.

A liquid discharging apparatus according to a first aspect of the invention includes a liquid discharging head configured to discharge liquid from nozzles in a discharged material transported in a first direction; a carriage configured to mount the liquid discharging head and reciprocate in a second direction which intersects the first direction; and a carriage moving unit configured to reciprocate the carriage, and the carriage moving unit includes a first drive unit and a second drive unit operating independently from each other, and a first supporting portion of the first drive unit with respect to the carriage and a second supporting portion of the second driving unit with respect to the carriage are located at positions displaced in the first direction.

In this configuration, since the two supporting portions such as the first supporting portion and the second supporting portion are provided, the carriage is restrained from swinging when staring movement, ending the movement, and changing the direction of movement, so that the posture of the carriage is stabilized.

The first drive unit and the second drive unit are provided so as to be operated independently, and the first supporting portion of the first drive unit with respect to the carriage and the second supporting portion of the second drive unit with respect to the carriage are arranged at positions displaced in the direction of transport of the discharged material, which corresponds to the first direction. Therefore, by operating the first drive unit and the second drive unit independently with respect to each other, adjustment of the relative positions of the first supporting portion and the second supporting portion in the direction of the movement of the carriage (second direction) is enabled. With the adjustment of the relative positions, adjustment of the inclination of the nozzle rows of the liquid discharging head mounted on the carriage (the inclination with respect to the direction of transport of the discharged material) is enabled, so that reduction of the displacement of the liquid drop positions caused by the inclination of the nozzle rows is achieved.

Preferably, the first supporting portion is provided at a position on the side of a rear surface of the carriage, which corresponds to the upstream side in the direction of transport of the discharged material, and the second supporting portion is provided at a position on the side of a front surface of the carriage.

In this configuration, since the first supporting portion of the first drive unit with respect to the carriage and the second supporting portion of the second drive unit with respect to the carriage are positioned respectively on the side of the rear surface and on the side of the front surface of the carriage, the carriage is prevented from swinging and, since the distance between the first supporting portion and the second supporting portion is increased, finer adjustment of inclination of the nozzle rows is enabled.

By arranging the first supporting portion and the second supporting portion in such a manner that the center of gravity of the carriage is positioned at the center of a segment connecting the first supporting portion and the second supporting portion, the swinging of the carriage as in the related art is prevented with higher degree of reliability.

Preferably, a control unit configured to control driving of the first drive unit, the second drive unit, and the liquid discharge head is provided, and the control unit controls relative driving conditions between the first drive unit and the second drive unit on the basis of amounts of correction for correcting the displacement of the liquid drop positions between upstream side nozzles and downstream side nozzles of the nozzle rows of the liquid discharging head in terms of the second direction in association with the movement of the carriage at the time of the driving, and the amounts of correction are set individually for an outward movement and a homeward movement of the carriage.

In this configuration, the first drive unit and the second drive unit are provided so as to operate independently from each other, and the first supporting portion of the first drive unit with respect to the carriage and the second supporting portion of the second drive unit with respect to the carriage are arranged at a position displaced in the direction of transport of the discharged material (first direction), adjustment of the relative position of the first supporting portion and the second supporting portion in terms of the direction of movement of the carriage (second direction) is achieved by operating the first drive unit and the second drive unit independently from each other. With the adjustment of the relative position, reduction of the displacement of the liquid drop positions between the upstream side nozzles and the downstream side nozzles of the nozzle rows in association with the movement of the carriage caused by the difference of the discharge velocity and/or the drop distance according to the discharging position of the liquid discharged from the nozzles of the nozzle rows in the direction of transport of the discharged material is achieved. Since the two supporting portions such as the first supporting portion and the second supporting portion are provided, the carriage is restrained from swinging when staring movement, ending the movement, and changing the direction of movement, so that the posture of the carriage is stabilized.

In the configuration described above, the amounts of correction may be set by discharging liquid from the liquid discharging head onto the discharged material while moving the carriage independently for the respective liquid discharging modes, forming test patterns individually for the outward and homeward movements for the respective modes, obtaining the respective amounts of displacement of the drop positions in terms of the primary scanning direction of the carriage from the respective test patterns formed independently, and determining the amounts of correction on the basis of the amounts of displacement for the respective modes, the length of the nozzle rows, and the distance between the first supporting portion and the second supporting portion.

In this configuration, since the amounts of displacement of the drop positions corresponding to the difference of the discharge velocity and/or drop distance according to the discharged position of liquid to be discharged from the nozzles of the nozzle rows in terms of the direction of transport of the discharged material are obtained by printing the test patterns, practical and accurate setting of the operation timing between the first drive unit and the second drive unit is achieved. Since the amounts of correction are set on the basis of the amounts of displacement for the respective modes, the length of the nozzle rows, and the distance between the first supporting portion and the second supporting portion, the actual displacement of the liquid drop positions is easily adjusted to be reduced in association with the distance between the first supporting portion and the second supporting portion by absorbing the positional difference between the position of the nozzle rows and the first supporting portion and the second supporting portion to be actually adjusted.

Preferably, the first drive unit and the second drive unit each include a drive motor, a drive pulley provided at one end of the direction of movement of the carriage and connected to an output shaft of the drive motor, a driven pulley provided at the other end of the direction of movement of the carriage, a belt wound between the drive pulley and the driven pulley, and a connecting member which connects the carriage and part of the belt at the first supporting portion and the second supporting portion.

In this configuration, the displacement of the liquid drop positions on the basis of the inclination of the nozzle rows is prevented with a simple configuration such that the two drive units for the carriage having the same configuration as the existing one, and reduction of the swing of the carriage and stabilization of the posture of the carriage are achieved.

Also, by arranging the respective components of the first drive unit and the components of the second drive unit in lateral symmetry with respect to the direction of movement of the carriage and in symmetry in the fore-and-aft direction with respect to the direction of transport of the discharged material, reliability and stability of the effects and advantages are enhanced by the symmetric property thereof.

Preferably, a control unit configured to control driving of the first drive unit, the second drive unit, and the liquid discharge head is provided, and the control unit controls relative driving conditions between the first drive unit and the second drive unit on the basis of amounts of correction for correcting the displacement of the liquid drop positions between the upstream side nozzles and the downstream side nozzles of the nozzle rows of the liquid discharging head in terms of the second direction in association with the movement of the carriage at the time of the driving.

In this configuration, the control unit configured to control driving of the first drive unit, the second drive unit, and the liquid discharge head is provided, and the control unit includes the amounts of correction for correcting the displacement of the liquid drop positions (displacement in the second direction) between the upstream side nozzles and the downstream side nozzles of the nozzle rows of the liquid discharging head in association with the movement of the carriage at the time of the driving. Therefore, the problem of the displacement of the liquid drop positions caused by the inclination of the nozzle rows in association with the movement of the carriage is easily alleviated by operating the first drive unit and the second drive unit which may be driven independently from each other after having corrected by the corresponding amounts of correction.

Preferably, the control unit configured to control driving of the first drive unit, the second drive unit, and the liquid discharging head is provided, and a first position detector configured to detect the position of the first supporting portion in the direction of movement of the carriage and a second position detector configured to detect the position of the second supporting portion in the direction of movement of the carriage are provided.

In this configuration, the first drive unit and the second drive unit are provided so as to operated independently from each other, and the first supporting portion of the first drive unit with respect to the carriage and the second supporting portion of the second drive unit with respect to the carriage are arranged at positions displaced in the direction of transport of the discharged material (first direction). Therefore, by operating the first drive unit and the second drive unit independently with respect to each other, adjustment of the relative positions of the first supporting portion and the second supporting portion in the direction of the movement of the carriage (second direction) is enabled. With the adjustment of the relative positions, adjustment of the inclination of the nozzle rows of the liquid discharging head mounted on the carriage (the inclination with respect to the direction of transport of the discharged material) is enabled, so that reduction of the displacement of the liquid drop positions caused by the inclination of the nozzle rows is achieved.

Alternatively, with the adjustment of the relative position, reduction of the displacement of the liquid drop positions between the upstream side nozzles and the downstream side nozzles of the nozzle rows in association with the movement of the carriage caused by the difference of the discharge velocity and/or the drop distance according to the discharging position of the liquid discharged from the nozzles of the nozzle rows in the direction of transport of the discharged material is achieved.

Also, since the two supporting portions such as the first supporting portion and the second supporting portion are provided, swinging of the carriage is alleviated when staring movement of the carriage, ending the movement, and changing the direction of movement, so that the posture of the carriage is stabilized.

In addition to the effects and advantages as described above, the following effects and advantages as shown below will be achieved. As a result of employment of the structure in which the carriage is moved not by a single drive source, but by the first drive unit and the second drive unit which operate independently from each other, the carriage might be displaced from a preset moved position or the posture of the carriage due to variations in operating states of the respective drive sources, slight deviation of the synchronous state, or a change with time occurred when moving one carriage by a plurality of the drive sources. In this configuration, even in the case of such the displacement, since the first position detector configured to detect the position of the first supporting portion in the direction of movement of the carriage and the second position detector configured to detect the position of the second supporting portion in the direction of movement of the carriage are provided, individual detection of the degrees of displacement is achieved. Therefore, correction of the displacement using detected data is enabled.

Preferably, an operation correcting unit configured to obtain the amount of positional displacement between the first supporting portion and the second supporting portion from positional data of the first supporting portion detected by the first position detector and positional data of the second supporting portion detected by the second position detector and correct the operation of the control unit on the basis of the obtained amount of the positional displacement is provided.

The control unit is configured to cause the carriage to move on the basis of the preset data. In this case, even when the actual position of movement or the posture of the carriage is displaced from the preset data due to the variations of the operating state, the slight deviation of the synchronous state of the first drive unit and the second drive unit, or the change with time, the operation control unit corrects the operation of the control unit in the direction to reduce the amount of displacement. Therefore, the displacement is automatically corrected.

In the configuration described above, the control unit controls relative driving conditions between the first drive unit and the second drive unit on the basis of amounts of correction for correcting the displacement of the liquid drop positions between the upstream side nozzles and the downstream side nozzles of the nozzle rows of the liquid discharging head in terms of the second direction in association with the movement of the carriage at the time of the driving.

For example, the problem of the displacement of the liquid drop positions caused by the inclination of the nozzle row in association with the movement of the carriage is easily solved by operating the first drive unit and the second drive unit which may be driven independently from each other after having corrected by the corresponding amounts of correction. Alternatively, reduction of the displacement of the liquid drop positions in association with the movement of the carriage caused by the difference of the discharge velocity and/or the drop distance according to the discharging position of the liquid discharged from the nozzles of the nozzle rows in the direction of transport of the discharged material is achieved. Furthermore, even when the correction by the amounts of correction is no longer accurate with time and hence a displacement is resulted, according to the configuration described above, the displacement is also detected and hence the problem of displacement of the liquid drop positions caused by the inclination of the nozzle is alleviated stably for a long time.

Preferably, the amounts of correction are amounts for differentiating the timing of operation between the first drive unit and the second drive unit.

According to this configuration, the amounts of correction are the amounts for differentiating the timing of operation between the first drive unit and the second drive unit. Therefore, in a case where the liquid discharging head is mounted on the carriage in the inclined state, reduction or elimination of the angle of inclination of the nozzle rows of the liquid discharging head is enabled by activating one of the first drive unit and the second drive unit first and then causing the same to move in the state in which the carriage is inclined in a predetermined direction.

According to the configuration described above, the displacement of the liquid drop positions between the upstream side nozzles and the downstream side nozzles of the nozzle rows in association with the movement of the carriage is reduced by activating one of the first drive unit and the second drive unit first and causing the same to move in the state in which the carriage is inclined in the predetermined direction when the discharge velocity and/or the drop distance is different according to the discharging position of the liquid discharged from the nozzles of the nozzle rows in the direction of transport of the discharged material.

When the amounts of correction are the amounts of correction for correcting the displacement of the liquid drop positions caused by the difference of the discharging velocity and/or drop distance according to the discharging position of the liquid discharged from the nozzles of the nozzle rows in the nozzle discharging head in the direction of transport of the discharged material, the displacement of the liquid drop positions caused by the difference of the discharging velocity and/or the drop distance according to the discharging position of the liquid discharged from the nozzles of the nozzle rows of the liquid discharging head in the direction of transport of the discharged material is reduced.

When the amounts of correction are amounts of correction on the basis of consideration such that the inclination of the nozzle rows in the liquid discharging head is also a cause of the displacement of the liquid drop position, since the inclination of the nozzle rows is also included in the causes of the displacement of the liquid drop position, almost all the causes of occurrence of the displacement of the liquid drop positions are addressed, so that further reduction of the displacement of the liquid drop positions is achieved.

In this specification, the "amounts of correction on the basis of consideration such that the inclination of the nozzle rows in the liquid discharging head is also a cause of the displacement of the liquid drop position" includes both a case where an amount of correction for the displacement of the drop position caused by the inclination of the nozzle rows is additionally provided and the both amounts of correction are applied in combination for the outward and homeward movements of the carriage and for the respective liquid discharging modes, and a case where the amounts of correction are combined in advance respectively for the outward and homeward movements of the carriage and for the respective liquid discharging modes are applied as one amount of correction.

In this configuration, in a case where the liquid discharging head is mounted on the carriage in the inclined state, the displacement of the liquid drop positions may be reduced easily by activating one of the first drive unit and the second drive unit first and then causing the same to move in the state in which the carriage is inclined in the predetermined direction. Then, the operation control unit is capable of automatically reducing the displacement from the original position of movement and the posture of the carriage caused by the change with time by differentiating the operation timings of the first drive unit and the second drive unit.

Preferably, the control unit is adapted to activate the first drive unit and the second drive unit to change the posture of the carriage by the amounts of correction in an initial stage when the carriage is started to be driven from the waiting posture by the first drive unit and the second drive unit, and drives the carriage while maintaining the posture after the change.

When the cause of the displacement of the liquid drop positions is in the inclination of the nozzle rows, the displacement of the liquid drop positions does not occur by eliminating the inclination itself in advance. In this configuration, since the first drive unit and the second drive unit are adapted to be activated so as to change the posture of the carriage by an amount required for eliminating the inclination (by amounts corresponding to the amounts of correction) in the initial state when driving by the first drive unit and the second drive unit is started, and then the carriage is driven while maintaining the posture after the change, the problem of the displacement of the liquid drop positions is alleviated by a simple control.

Preferably, the amounts of correction is set for each of a plurality of positions in the direction of movement of the carriage.

There is a case where the inclination of the nozzle rows with respect to the direction of transport of the discharged material is changed according to the difference in position in the direction of movement of the carriage due to the deflection of the supporting shaft of the carriage or the deflection of the frame. This configuration is aimed at such the case and, since the amounts of correction are set for the plurality of positions in the direction of movement of the carriage respectively, the probability of occurrence of the problem of change in the inclination of the nozzle rows by the difference in position in the direction of movement of the carriage is reduced, and hence reduction of the displacement of the liquid drop positions is achieved.

Alternatively, the degree of difference in the discharging velocity and/or the drop distance of the liquid discharged from the nozzles of the nozzle rows depending on the difference of the discharging position in terms of the direction of transport of the discharged material and hence the inclination of the nozzle rows with respect to the direction of transport of the discharged material may be changed depending on the difference in position in the direction of movement of the carriage caused by the deflection of the supporting shaft of the carriage or the deflection of the frame. This configuration is aimed at such the case and, since the amounts of correction are set for the plurality of positions in the direction of movement of the carriage respectively, the probability of occurrence of the problem of change in the degree of difference of the discharging velocity and/or the liquid drop distance and thus the problem of change in the inclination of the nozzle rows by the difference in position in the direction of movement of the carriage is reduced, and hence reduction of the displacement of the liquid drop positions is achieved.

A second aspect of the invention is a liquid discharging apparatus configured to transport a discharged material in a first direction while supporting the same and discharge liquid from nozzle rows provided so as to oppose a supporting surface for supporting the discharged material, including a carriage configured to cause the nozzle rows to reciprocate in a second direction, a rotary mechanism configured to rotate the nozzle rows in the direction of axis of rotation vertical to the supporting surface, and a control unit configured to control the rotation of the rotary mechanism on the basis of amounts of correction for correcting the displacement of the liquid drop positions in terms of the second direction between the upstream side nozzles and the downstream side nozzles of the nozzle rows, in which the amounts of correction are set individually for outward and homeward movements of the carriage.

A third aspect of the invention is a liquid discharging apparatus configured to transport a discharged material in a first direction while supporting the same and discharge liquid from nozzle rows provided so as to oppose a supporting surface for supporting the discharged material, including a carriage configured to cause the nozzle rows to reciprocate in a second direction, a rotary mechanism configured to rotate the nozzle rows in the direction of axis of rotation vertical to the supporting surface, and a control unit configured to monitor the posture of the nozzle rows in terms of rotation and control the rotation of the rotary mechanism on the basis of the posture.

A fourth aspect of the invention is a method of preventing displacement of liquid drop positions in a liquid discharging apparatus configured to discharge liquid from nozzles of a liquid discharging head mounted on the carriage on a discharged material while reciprocating the carriage, activating a first drive unit that supports the carriage at a first supporting portion and a second drive unit that supports the carriage at a second supporting portion shifted in the direction of transport of the discharged material with respect to the first supporting portion independently from each other to move the carriage, and adjusting the relative position of the carriage between the first supporting portion and the second supporting portion in terms of the direction of movement of the carriage in the direction to reduce the inclination of the nozzle rows of the liquid discharging head with respect to the direction of transport of the discharged material when moving the carriage.

A fifth aspect of the invention is a method of preventing displacement of liquid drop positions in a liquid discharging apparatus configured to discharge liquid from nozzles of a liquid discharging head mounted on the carriage on a discharged material while reciprocating the carriage, activating a first drive unit that supports the carriage at a first supporting portion and a second drive unit that supports the carriage at a second supporting portion shifted in the direction of transport of the discharged material with respect to the first supporting portion independently from each other to move the carriage, and adjusting the relative position of the carriage between the first supporting portion and the second supporting portion in terms of the direction of movement of the carriage in the direction to reduce the displacement of the liquid drop positions between the upstream side nozzles and the downstream side nozzles of the nozzle rows of the liquid discharge head in association with the movement of the carriage on the basis of the amounts of correction set individually for the outward and homeward movements, and the liquid discharging modes when moving the carriage.

A sixth aspect of the invention is a method of preventing displacement of liquid drop positions in a liquid discharging apparatus configured to discharge liquid from nozzles of a liquid discharging head mounted on the carriage on a discharged material while reciprocating the carriage, activating a first drive unit that supports the carriage at a first supporting portion and a second drive unit that supports the carriage at a second supporting portion shifted in the direction of transport of the discharged material with respect to the first supporting portion independently from each other to move the carriage, obtaining the amounts of positional displacement between the first supporting portion and the second supporting portion on the basis of the positional data of the first supporting portion detected by the first position detector and the positional data of the second supporting portion detected by the second position detector, and adjusting the relative position of the carriage between the first supporting portion and the second supporting portion in terms of the direction of movement of the carriage in the direction to reduce the obtained amount of positional displacement when moving the carriage.

BRIEF DESCRIPTION OF THE DRAWINGS

The invention will be described with reference to accompanying drawings, wherein like numbers reference like elements.

DESCRIPTION OF EXEMPLARY EMBODIMENTS

A liquid discharging apparatus will be described below. First of all, an ink jet printer 100 is taken as an example of the best mode for carrying out the invention as a liquid discharging apparatus 1, and a general configuration thereof will be described in brief on the basis of the drawings.

Figure 1:
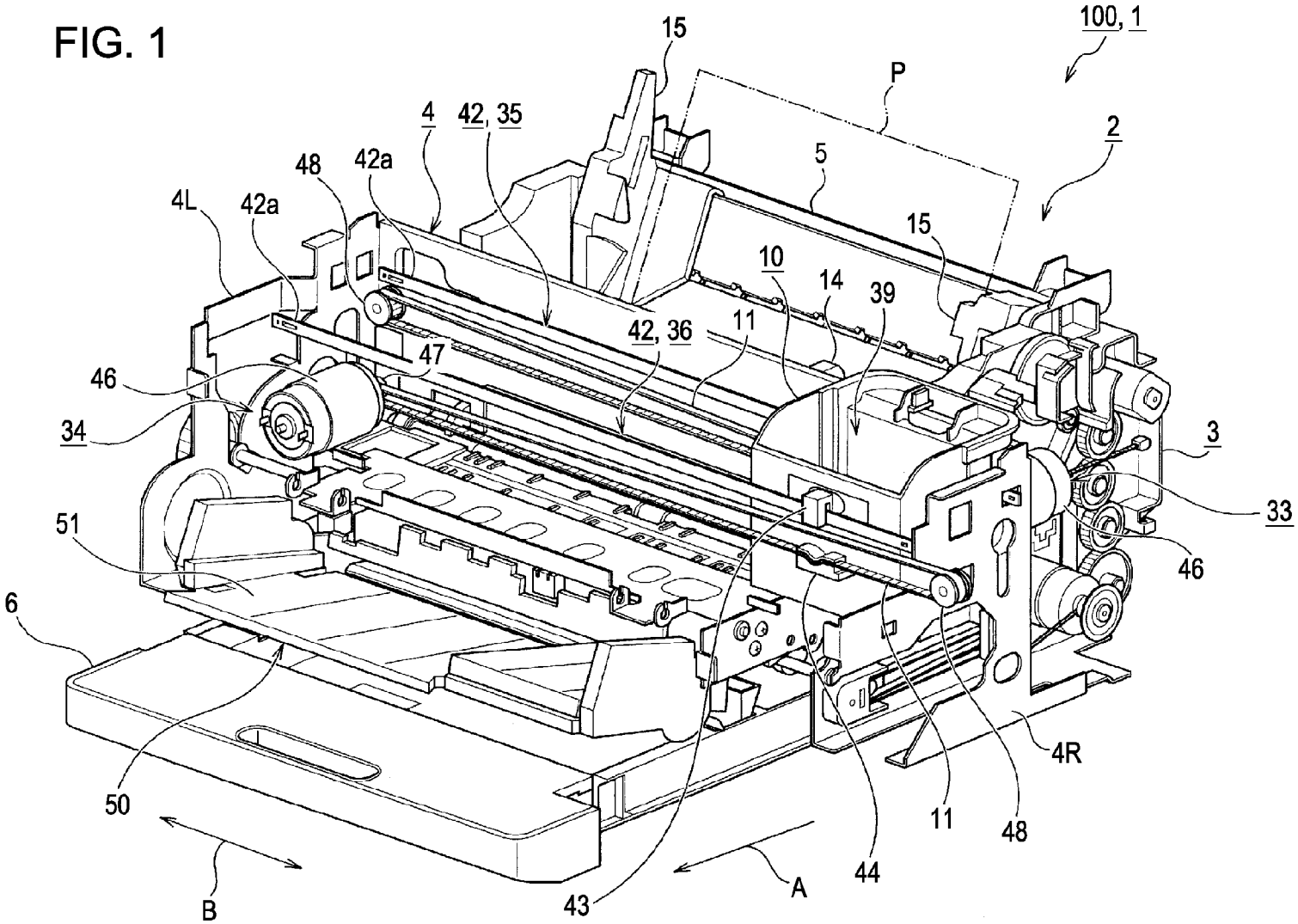
FIG. 1 is a perspective view showing an internal structure of an ink jet printer.
Figure 2:
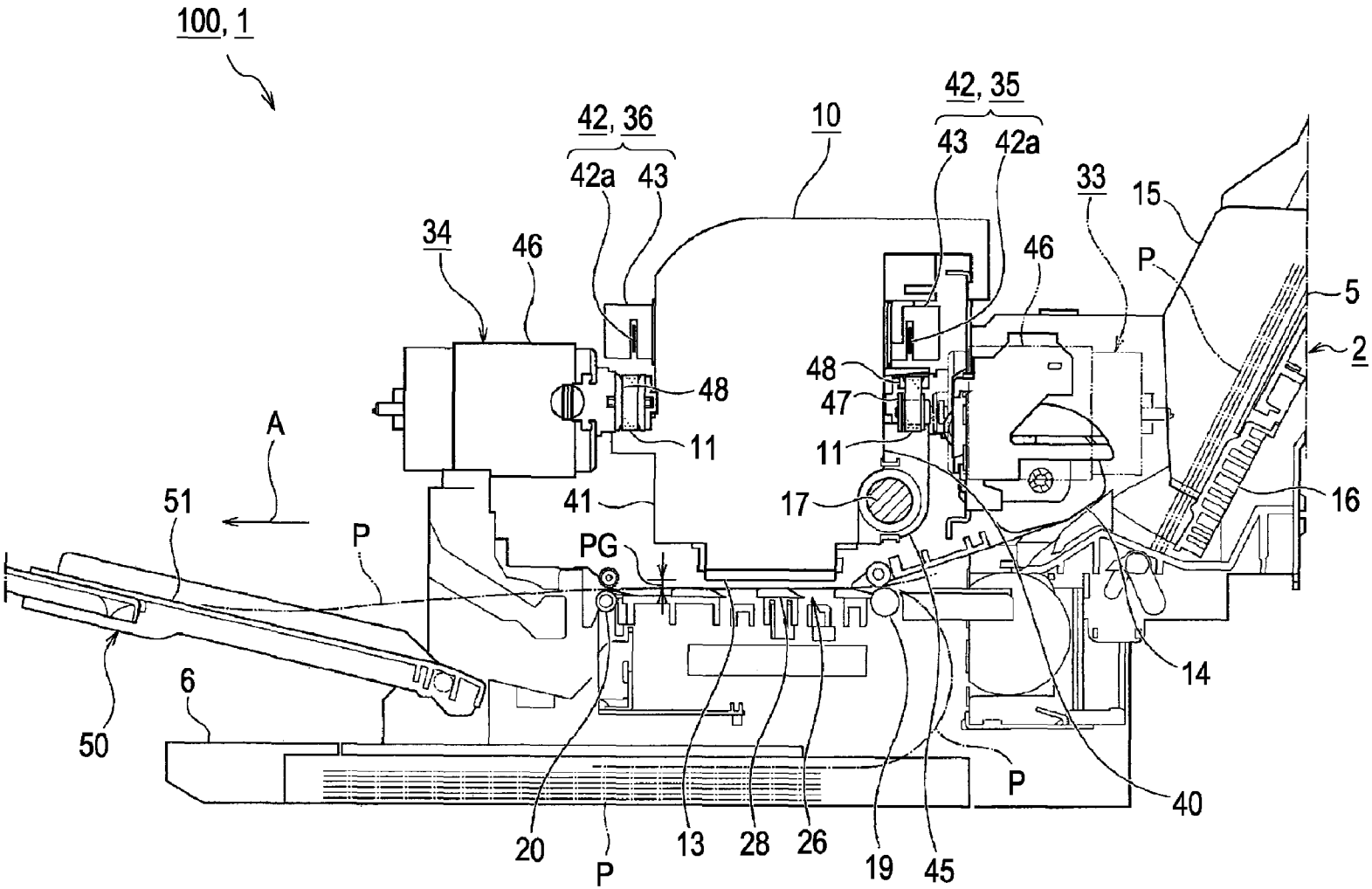
FIG. 2 is a side cross-sectional view showing a general internal structure of the ink jet printer.

FIG. 1 is a perspective view showing an internal structure of an ink jet printer, and FIG. 2 is a side cross-sectional view showing a general internal structure of the ink jet printer. The ink jet printer 100 shown in the drawing is a serial printer having a printhead 13 as a liquid discharging head mounted on a lower surface of a carriage 10 which reciprocates in a primary scanning direction B intersecting a transport direction A of a paper P as a discharged material.

The ink jet printer 100 includes a printer body 3 as a liquid discharging apparatus body, and includes a feeding tray 5 protruding obliquely upward toward the rear on a rear portion of the printer body 3. The feeding tray 5 is adapted to allow placing of a plurality of pieces of paper P stacked thereon. The paper P stacked on the feeding tray 5 is guided at left and right side edges (edges) thereof by left and right edge guides 15 and 15, and is automatically fed in sequence by a nipping and feeding operation of a feeding roller 14 and a hopper 16 as other components which constitute an automatic feeding apparatus 2 together with the feeding tray 5.

Then, the automatically fed paper P is delivered to a position of a carrier roller 19 which includes a pair of nip rollers of a carrier drive roller and a carrier driven roller. Then, the paper P is guided to a printing position 26 by a transport power of the carrier roller 19. Provided at the printing position 26 are the printhead 13 as a print executing member, the carriage 10 having the printhead 13 mounted thereon and moving in the primary scanning direction B, and a platen 28 configured to support the lower surface of the paper P to define a gap PG with respect to the printhead 13.

The paper P after having printed thereon is discharged on a placing surface 51 of a discharge stacker 50 provided at a downstream end of the transport direction A of the paper P by a discharge roller 20 including a pair of nip rollers of a discharge drive roller and a discharge driven roller and is stacked thereon. The ink jet printer 100 in the drawing includes a detachable feeding cassette 6 on which a number of pieces of paper P may be set in a lump below the discharge stacker 50.

Embodiments

Referring to the drawings, characteristic configurations of the liquid discharging apparatus 1 according to embodiments of the invention which are applied to the ink jet printer 100 configured as described above will be described in detail.

Figure 3:
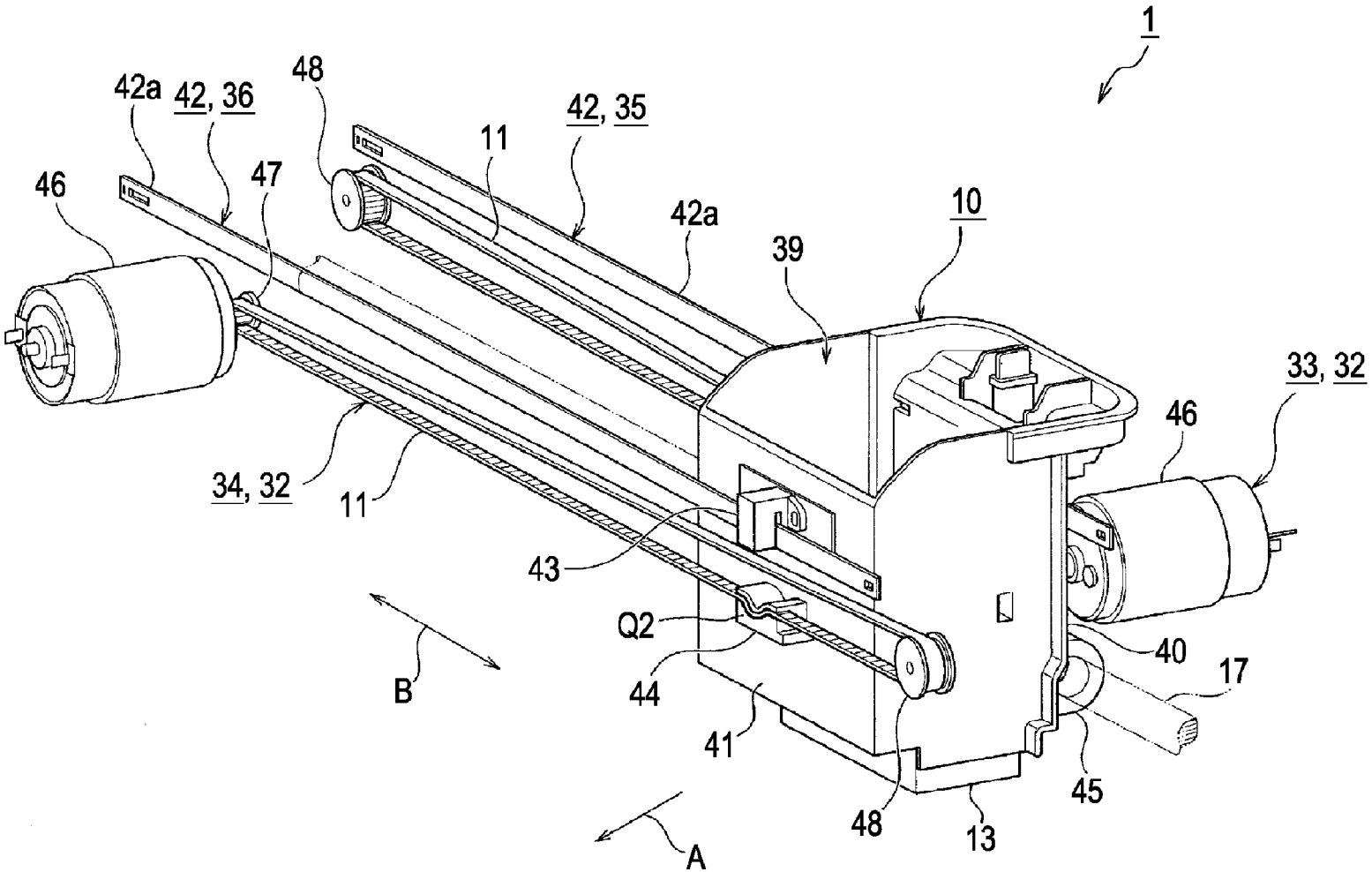
FIG. 3 is a perspective view showing a characteristic configuration of a liquid discharging apparatus.
Figure 4:
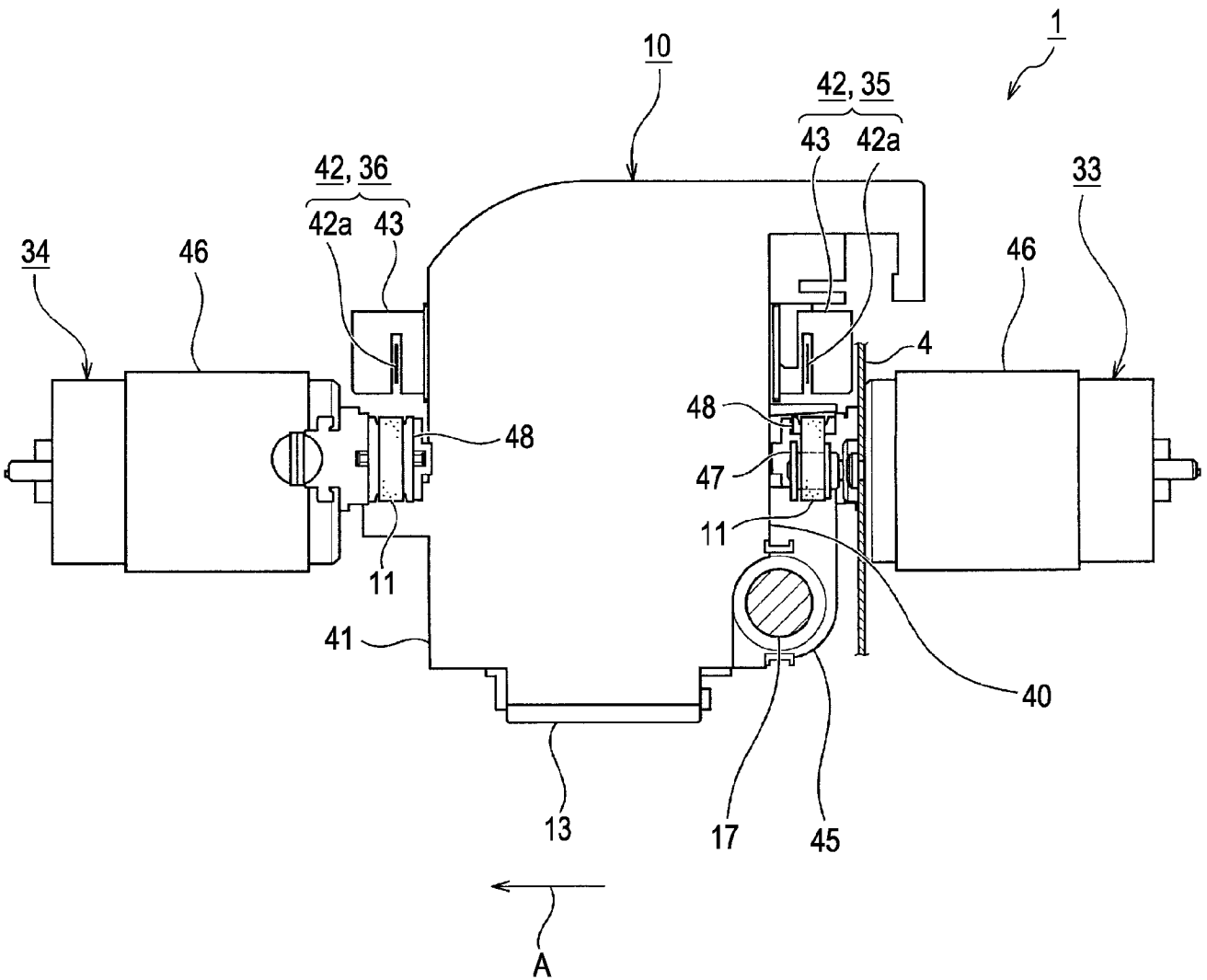
FIG. 4 is a side view showing the characteristic configuration of the liquid discharging apparatus.
Figure 5:
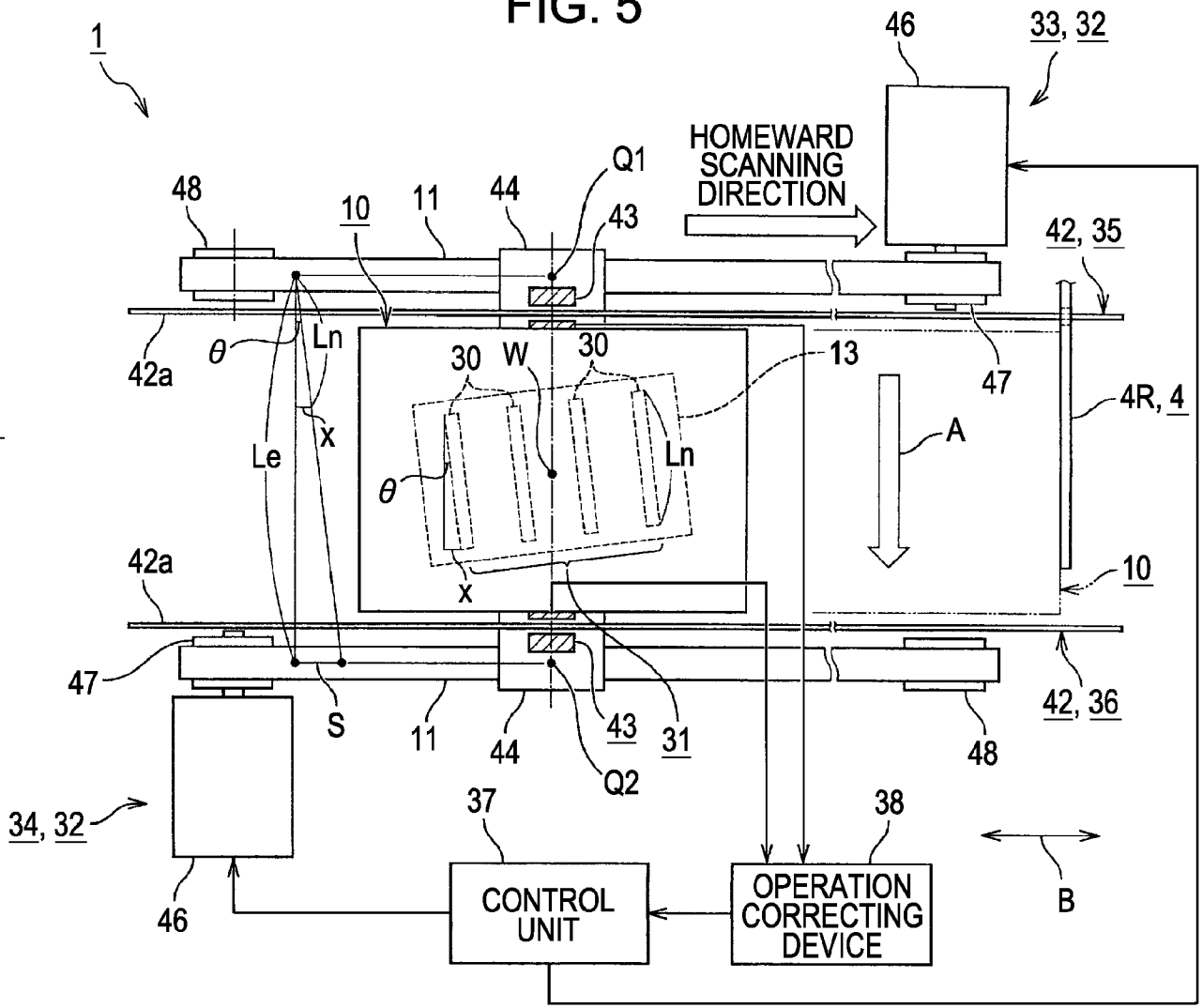
FIG. 5 is a plan view showing the liquid discharging apparatus before setting an operation timing.
Figure 6:
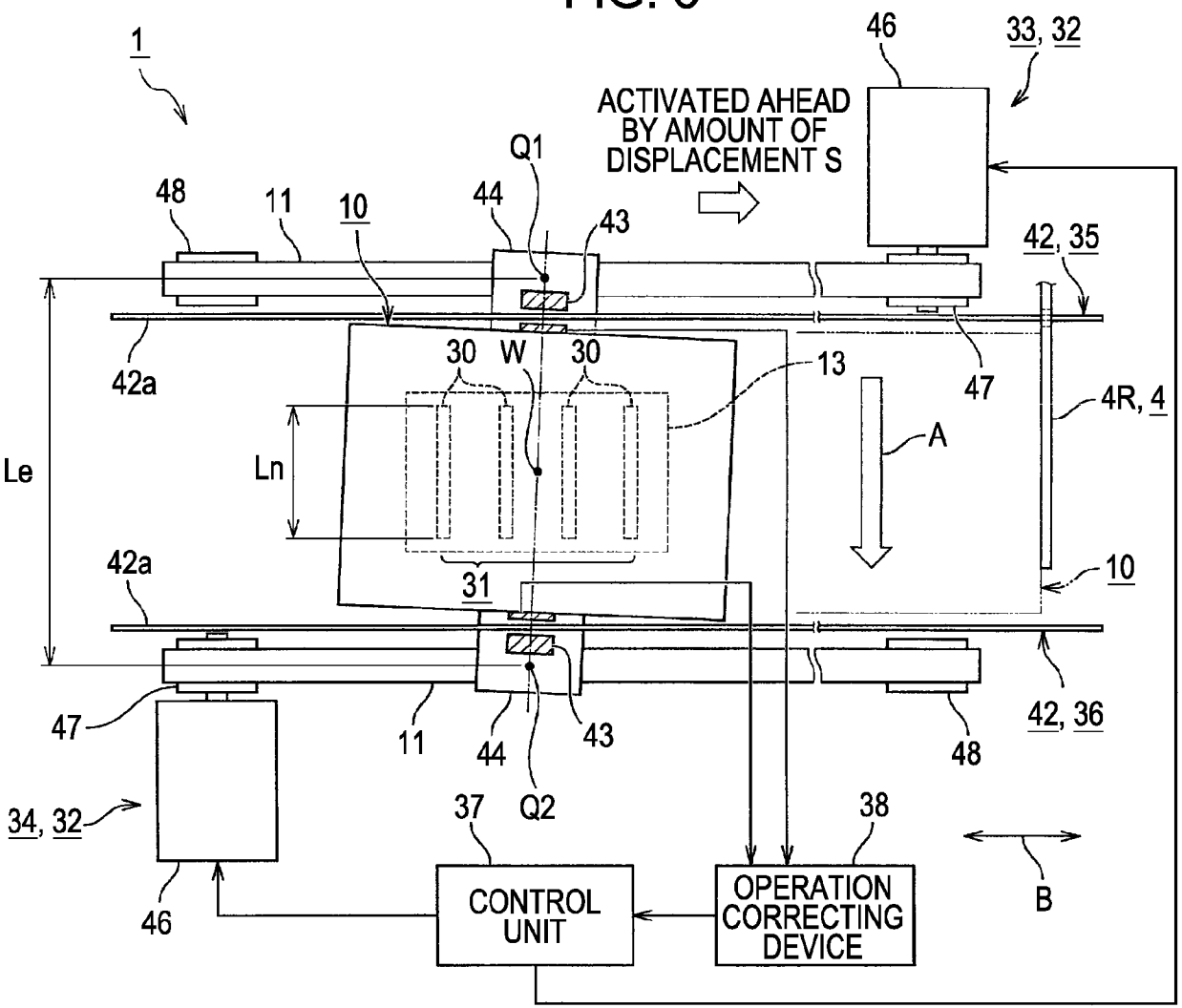
FIG. 6 is a plan view showing the liquid discharging apparatus after having set the operation timing.

FIG. 3 is a perspective view showing a principal portion of a liquid discharging apparatus according to an embodiment of the invention, and FIG. 4 is a side view showing the principal portion of the liquid discharging apparatus. FIG. 5 is a plan view showing the liquid discharging apparatus before setting an operation timing. FIG. 6 is a plan view showing the liquid discharging apparatus after having set the operation timing.

Figure 7:
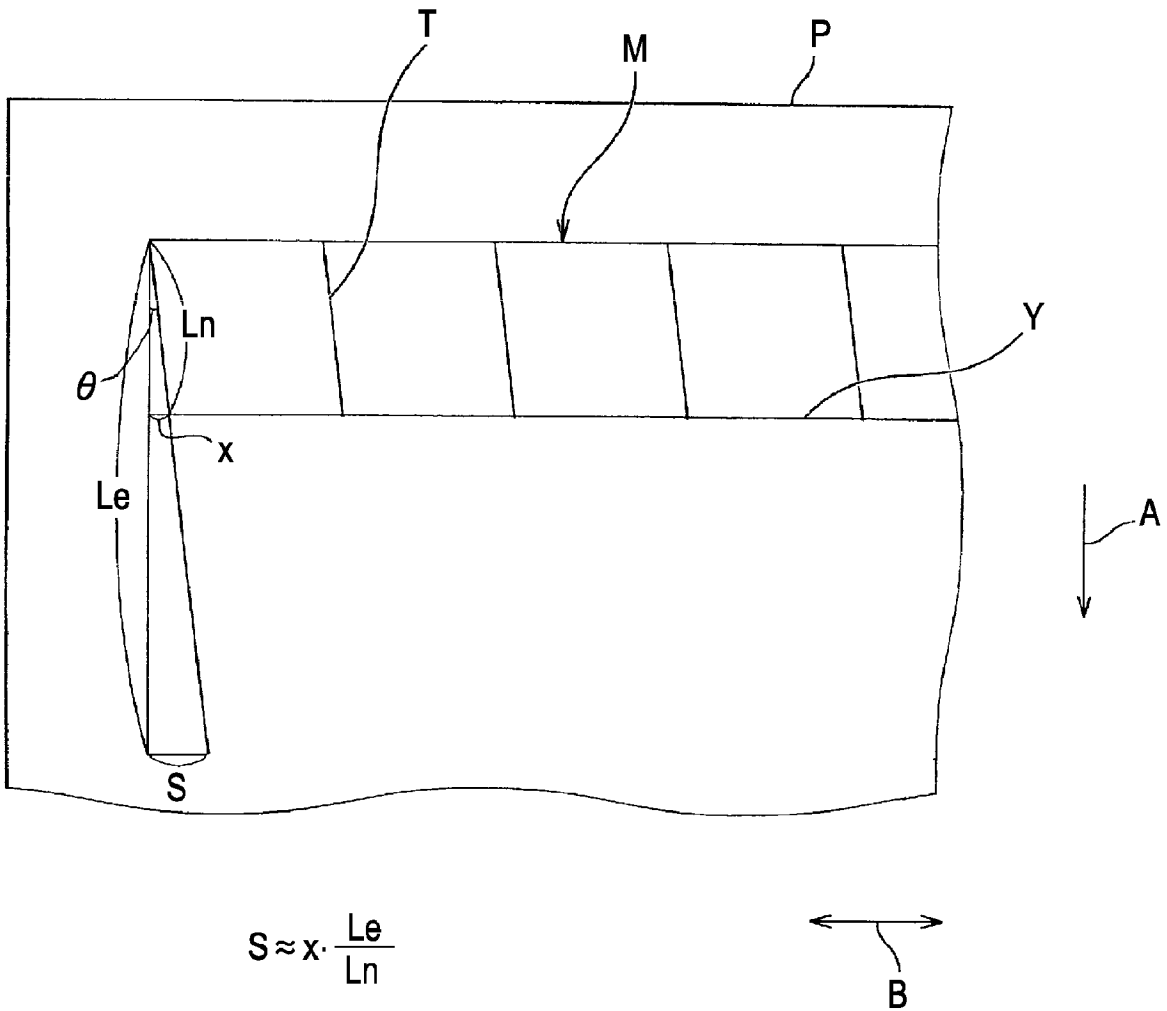
FIG. 7 is a plan view showing a printed result of a test pattern before setting the operation timing.
Figure 8:
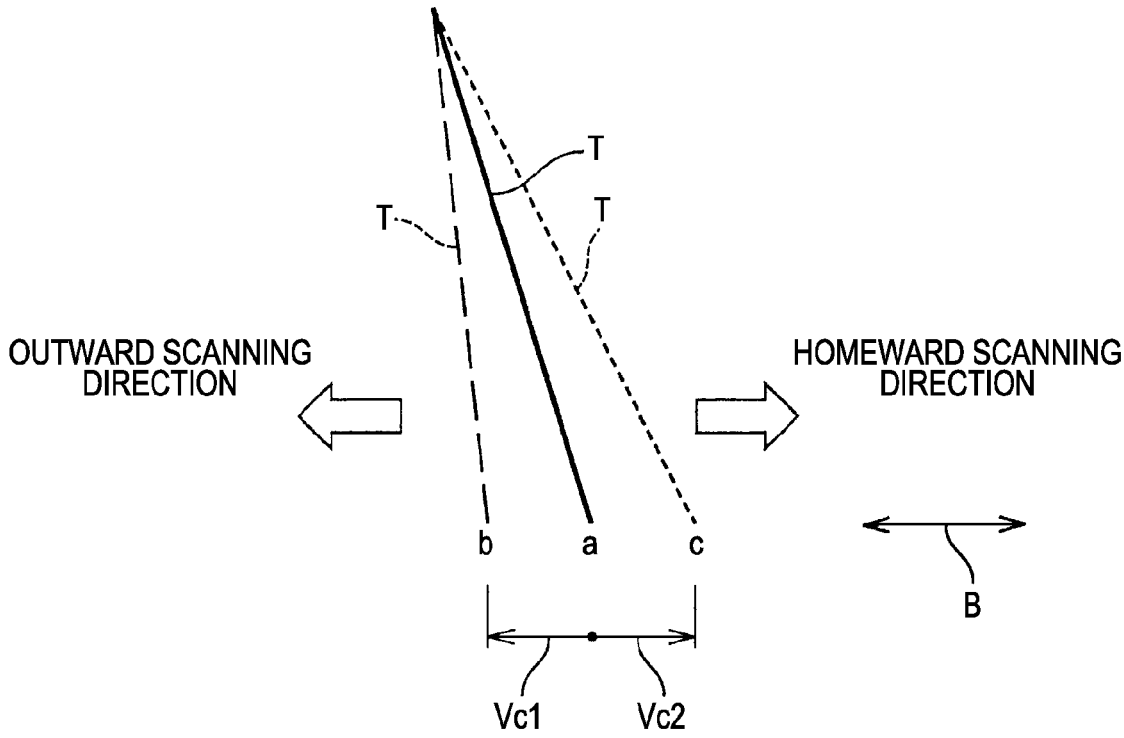
FIG. 8 is a plan view showing an inclination of a vertical rule mark at the times of a low-velocity operation, an outward scanning, and a homeward scanning.
Figure 9:
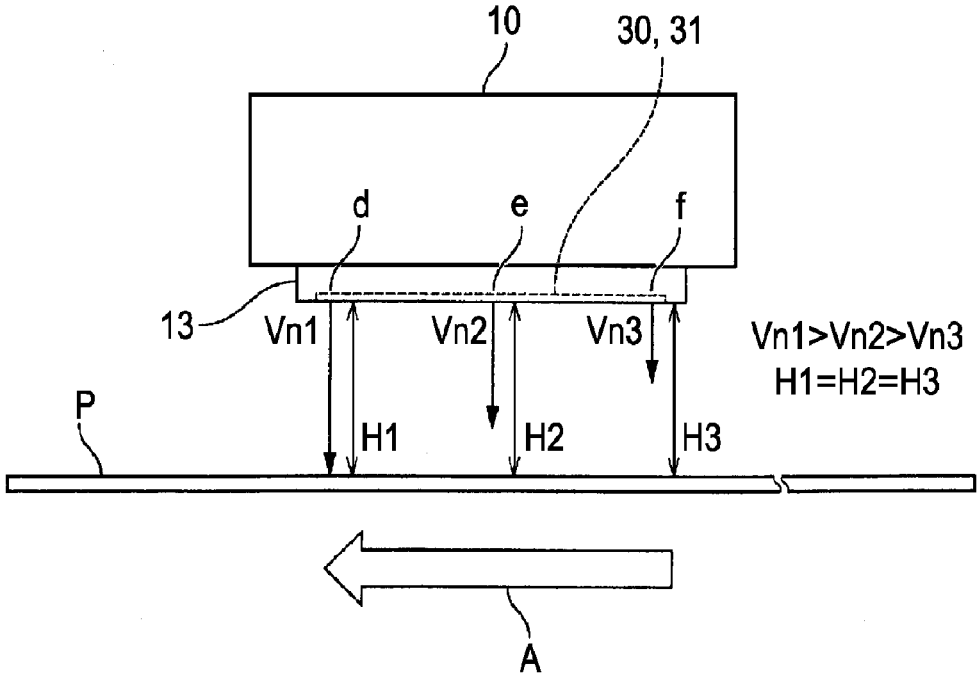
FIG. 9 is a side view showing a case where an ink discharging velocity is different depending on the position of nozzles in terms of the direction of transport of a paper.
Figure 10:
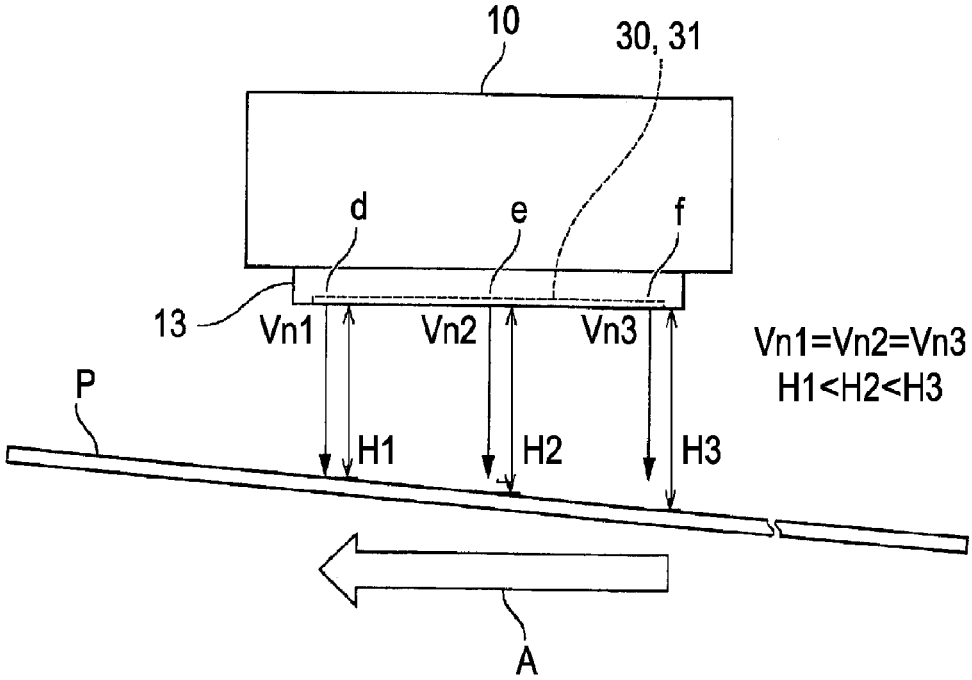
FIG. 10 is a side view showing a case where the height of the paper is different depending on the position of the nozzles in terms of the direction of transport of the paper.
Figure 11:
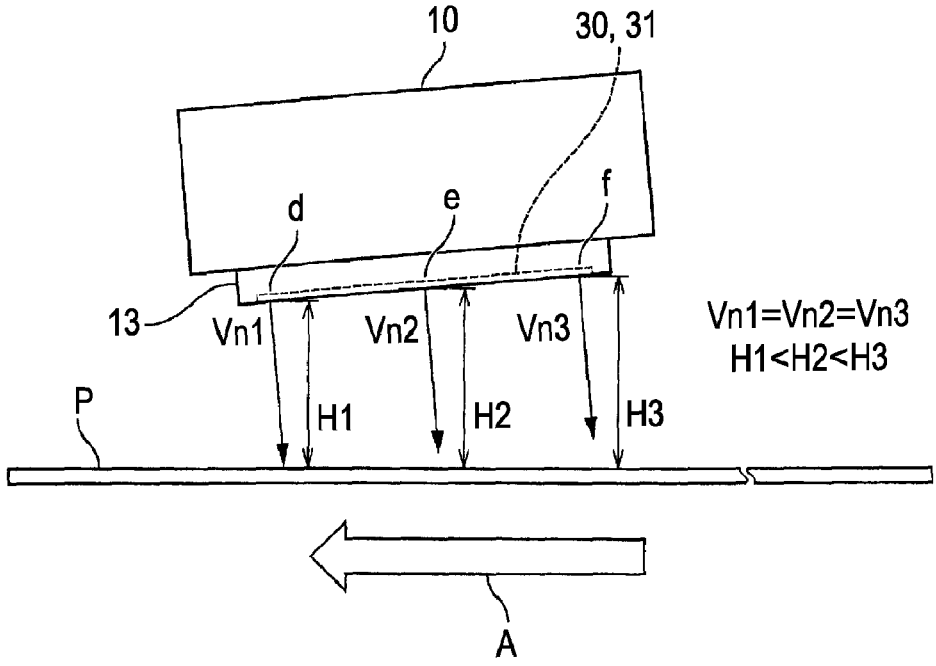
FIG. 11 is a side view showing a case where the height of nozzle ports is different depending on the position of the nozzles in terms of the direction of transport of the paper.
Figure 12:
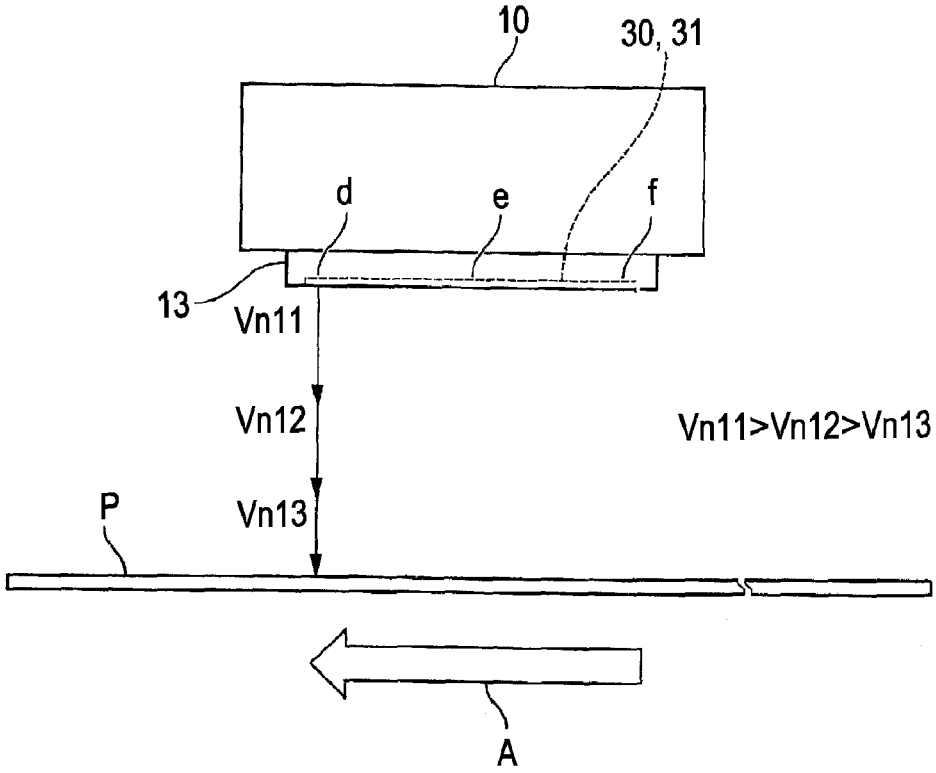
FIG. 12 is a side view showing a state in which the ink discharge velocity changes depending on the difference in drop distance from the nozzles to the paper.
Figure 13:
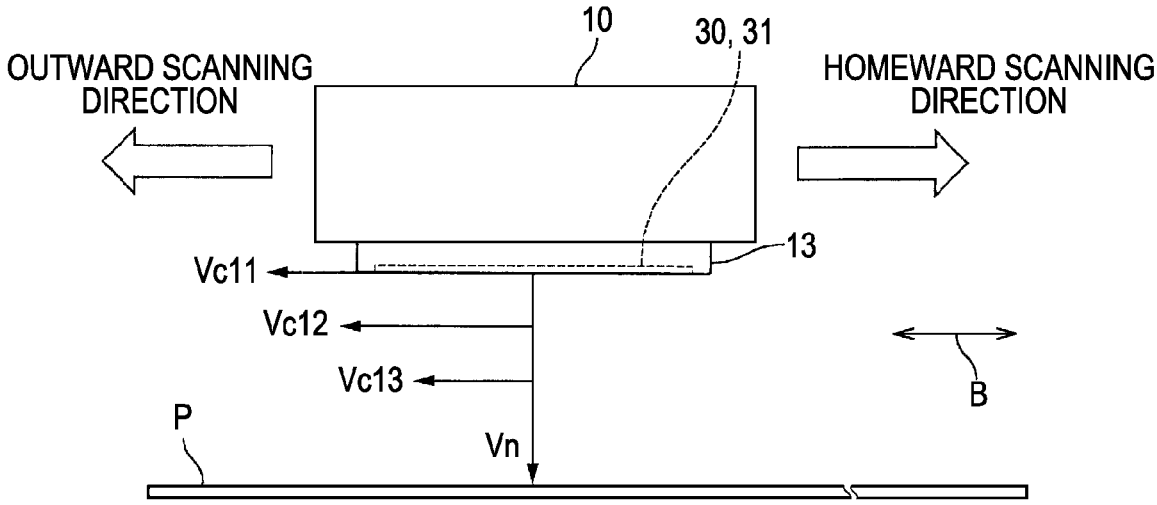
FIG. 13 is a side view showing a state in which the velocity of the carriage changes depending on the difference in the drop distance from the nozzles to the paper.
Figure 14:
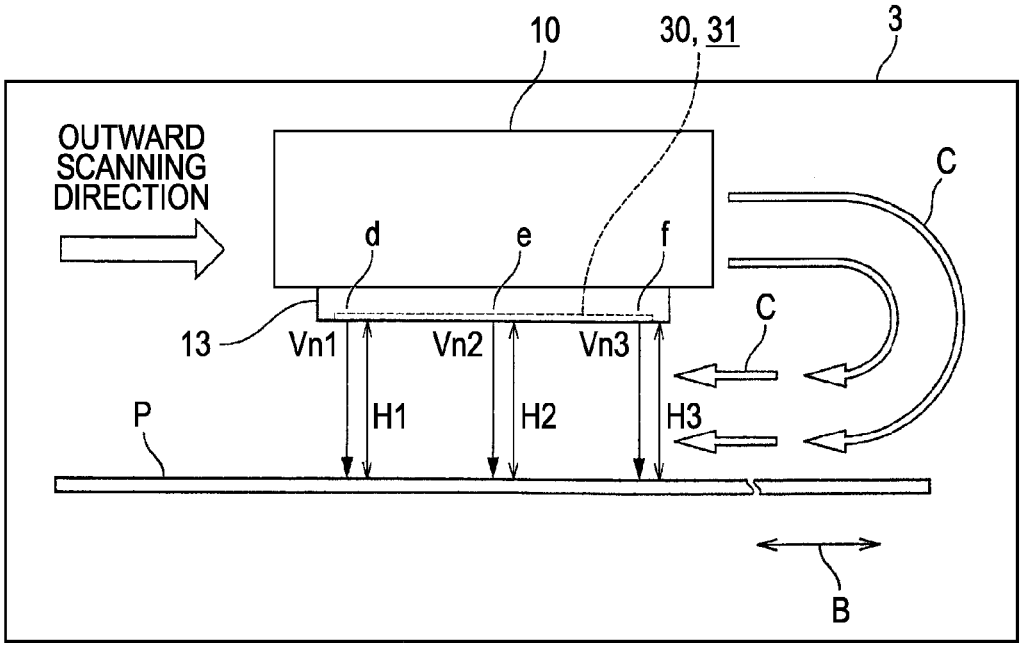
FIG. 14 is a side view showing an influence of air generated at the time of scanning with the carriage.
Figure 15:
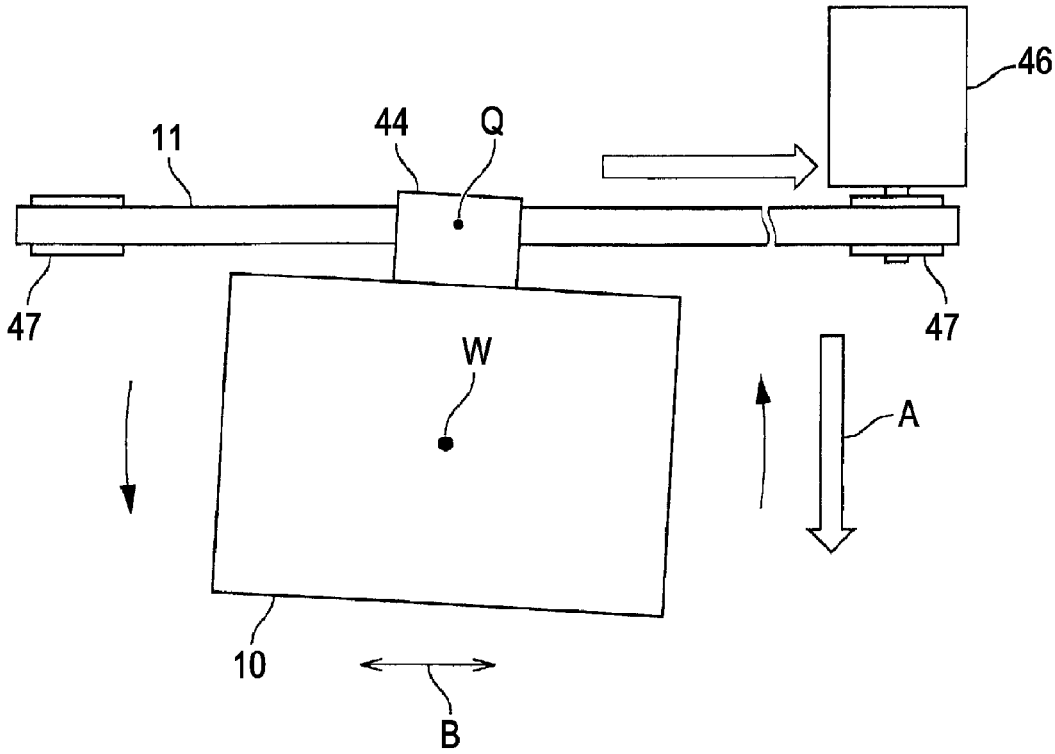
FIG. 15 is a plan view showing an inclination of the carriage occurred depending on the distance between the center of gravity and a supporting point of the carriage.

FIG. 7 is a plan view showing a printed result of a test pattern before setting the operation timing.

The liquid discharging apparatus 1 according to the embodiments of the invention includes the printhead 13 as a liquid discharging head, the carriage 10, and a carriage moving unit 32 configured to reciprocate the carriage 10 in the primary scanning direction B as characteristic components. The carriage moving unit 32 includes a first drive unit 33 and a second drive unit 34 configured to operate independently from each other, and a first supporting portion Q1 of the first drive unit 33 with respect to the carriage 10 and a second supporting portion Q2 of the second drive unit 34 with respect to the carriage 10 are provided at positions displaced in the transport direction A of the paper P. Since the two supporting portions such as the first supporting portion Q1 and the second supporting portion Q2 are provided, the carriage 10 is restrained from swinging occurring when the carriage 10 starts to move, ends to move, and changes the direction of movement, so that the posture of the carriage 10 is stabilized.

In addition, in addition to the components descried above, the liquid discharging apparatus 1 according to the embodiments shown in the drawings includes a control unit 37 configured to control an operation of the carriage moving unit 32, a first position detector 35 configured to detect the position of the first supporting portion Q1 at a connecting portion between the carriage 10 and a toothed belt 11, a second position detector 36 configured to detect the position of the second supporting portion Q2 at the connecting portion, and a operation correcting device 38 configured to correct the operation of the control unit 37.

The printhead 13 executes a desired print job by discharging ink as an example of the liquid onto the paper P from nozzles 30 which constitute nozzle rows 31. Respective colors of ink are supplied from ink cartridges, not shown, which are mounted on the carriage 10 to the printhead 13, and the ink is discharged from the nozzles 30 of the nozzle rows 31 formed as openings on the lower surface of the printhead onto the paper P at a predetermined ink discharge velocity Vn. In the embodiments, the nozzle rows 31 include four rows (corresponding to the respective colors of yellow, magenta, cyan, and black) as an example. The four nozzle rows 31 are all designed to have the nozzles 30 aligned along the transport direction A of the paper P. In FIG. 5 and FIG. 6, the length indicated by an reference sign Ln indicates the length of the nozzle rows 31, that is, the "length of the nozzle rows".

The carriage 10 includes the printhead 13 mounted thereon and reciprocates in the primary scanning direction B integrally with the printhead 13. The carriage 10 is formed of a square box-shaped container-like member in the embodiments, and is configured to detachably accommodate ink cartridges, not shown, in a storage unit 39 opened on top. The carriage 10 is configured in such a manner that a rotatable lid member, not shown, is mounted on the opened top of the storage unit 39 so as to be openable and closable.

Provided at centers of a rear surface 40 and a front surface 41 of the carriage 10 are encoders 43 and 43 as components of a linear scale mechanism unit 42 which constitutes the first position detector 35 and the second position detector 36, and connecting members 44 and 44 for connecting the carriage 10 to the toothed belts 11 and 11, respectively. Also provided on the lower portion of the rear surface 40 of the carriage 10 is a guide shaft holder 45 which fits a carriage guide shaft 17 for guiding the carriage 10 to reciprocate in the primary scanning direction B (FIG. 3 and FIG. 4).

As shown in FIG. 5 and FIG. 6, the carriage moving unit 32 includes the first drive unit 33 and the second drive unit 34 configured to operate independently from each other, and the first supporting portion Q1 of the first drive unit 33 with respect to the carriage 10 and the second supporting portion Q2 of the second drive unit 34 with respect to the carriage 10 are provided in a positional relationship shifted in the transport direction A of the paper P. As shown in FIG. 3 and FIG. 4, in the embodiments, the first supporting portion Q1 is provided at the center position on the side of the rear surface 40 of the carriage 10, and the second supporting portion Q2 is provided at a position symmetrical to the first supporting portion Q1 at the center on the side of the front surface 41 of the carriage 10 in the fore-and-aft direction.

The first drive unit 33 includes a drive motor 46, a drive pulley 47 provided at one end of the carriage 10 in terms of the primary scanning direction B and mounted on an output shaft of the drive motor 46, a driven pulley 48 provided at the other end of the carriage 10 in terms of the primary scanning direction B and rotatably supported on a supporting frame 4 of the printer body 3, the toothed belt 11 wound between the drive pulley 47 and the driven pulley 48, and the connecting member 44 described above for connecting the carriage 10 and part of the toothed belt 11 at the first supporting portion Q1 and the second supporting portion Q2.

The second drive unit 34 is formed of the same components as the first drive unit 33, and hence it is only shown in the drawing and is not described (FIG. 3 to FIG. 6). As shown in FIG. 3 and FIG. 5, in this example, the respective components of the first drive unit 33 and the second drive unit 34 are arranged in lateral symmetry in the primary scanning direction B of the carriage 10 and fore-and-aft symmetry in the transport direction A of the paper P.

First Embodiment

For a First Cause of the Inclination of the Vertical Rule Mark

The control unit 37 is configured to control to correct the displacement of the ink drop positions caused by the structural inclination of the nozzle rows 31 of the printhead 13 with respect to the carriage 10 shown in FIG. 5 to FIG. 8 by differentiating the timings of operation of the first drive unit 33 and the second drive unit 34. In other words, the control unit 37 stores amounts of correction for correcting the displacement of the ink drop positions between the upstream side nozzles 30 and the downstream side nozzles 30 which constitute the nozzle rows 31 of the printhead 13 in association with the movement of the carriage 10 in a storage unit thereof. The amounts of correction, the method of setting of which will be described later, are used for correcting the displacement of the ink drop positions caused by the inclination of the nozzle rows 31 of the printhead 13, and relative driving conditions between the first drive unit 33 and the second drive unit 34 are controlled. Here, the amounts of correction are amounts for differentiating the timings of operation of the first drive unit 33 and the second drive unit 34.

In a first embodiment, the control unit 37 is configured to operate the first drive unit 33 and the second drive unit 34 independently so as to change the posture of the carriage 10 by the amounts of correction when the carriage 10 starts to move by being driven by the first drive unit 33 and the second drive unit 34 from the waiting posture when it is at a reference position of the movement of the carriage 10, for example, a position where the carriage 10 is in abutment with the supporting frame 4 (home position), or in the initial stage of operation before the printhead 13 reaches the ink discharging area. Then, the carriage 10 is configured to reciprocate while maintaining the posture after the change.

How to Set the Amounts of Correction

The amounts of correction are set in the following manner in the first embodiment. First of all, the carriage 10 is caused to be in the same posture as in the reference position and discharge the ink from the printhead 13 onto the paper P to form a test pattern while being stopped or traveling at a low velocity which is equivalent to the stopped state. Then, the amounts of displacement of the drop positions on the basis of the inclination of the nozzle rows 31 is measured from the test pattern, and the amounts of correction are set on the basis of the amount of displacement, the nozzle row length Ln, and a distance Le between the first supporting portion Q1 and the second supporting portion Q2.

Hereinafter, how to set the amounts of correction will be described separately on (a) Formation of Test Pattern, (b) Measurement of the Amount of Displacement of the Drop Positions, and (c) Timing of Operation.

As shown in FIG. 1, the carriage 10 is waiting at the home position to be ready for the formation of the test pattern. In the waiting state, the carriage 10 is in the state of being abutment with a side frame 4R on the right side of the supporting frame 4 when viewed from the front. On the basis of the posture of the carriage 10 in this state, measurement of an angle of inclination θ of the nozzle rows 31 and an amount of displacement x of the drop position on the basis of the angle of inclination θ, and setting of the timings of operation of the first drive unit 33 and the second drive unit 34, that is, setting of the amounts of correction are carried out.

(a) Formation of Test Pattern (see FIGS. 5 and 7)

First of all, ink is discharged from all the nozzles 30 of the nozzle rows 31 of the printhead 13 to form a rule mark M as a test pattern while traveling the carriage 10 at a low velocity onto a test paper P (FIG. 7). The term "low-velocity" here means a velocity which does not cause an influence of the velocity Vc of the carriage 10 on the ink discharged from the nozzles 30. A case where the printhead 13 is mounted on the carriage 10 in a state in which the nozzle rows 31 are inclined by the angle of inclination θ with respect to the transport direction A of the paper P as shown in FIG. 5, and the test pattern is printed on the paper P in a state in which a lateral rule mark Y is parallel to the primary scanning direction of the carriage 10 but a vertical rule mark T is inclined by the angle of inclination θ as shown in FIG. 7.

(b) Measurement of Amount of Displacement of Drop Position (see FIGS. 5 and 7)

As shown in FIG. 7, the length of the vertical rule mark T is the same as the nozzle row length Ln. By measuring the angle of inclination θ of the vertical rule mark T, the amount of displacement x of the drop position in terms of the primary scanning direction B per nozzle row length Ln on the basis of the angle of inclination θ of the nozzle rows 31 is obtained from $x=Ln\cdot\sin\theta$. The amount of displacement x of the drop position may also be obtained by direct measurement.

(c) Setting of Timing of Operation (see FIGS. 5 to 7)

The positions where the amount of displacement x of the drop position is actually corrected are the positions of the first supporting portion Q1 and the second supporting portion Q2. Therefore, it is necessary to convert the amount of displacement x into an amount of displacement S at the position of the first supporting portion Q1 or the position of the second supporting portion Q2.

The converted amount of displacement S has a relation of $S=x\cdot Le/Ln\cdot\cos\theta$ as shown in FIGS. 5 and 7. When the angle of inclination θ is small, the converted amount of displacement S may be obtained by $S\approx x\cdot Le/Ln$. The converted amount of displacement S corresponds to the amount of correction described above.

Therefore, by causing the first drive unit 33 to move before the second drive unit 34 by the amount of $S(\approx x\cdot Le/Ln)$, the nozzle rows 31 extend along the transport direction A of the paper P as shown in FIG. 6, so that the displacement of the ink drop positions caused by the inclination of the nozzle rows is prevented.

When the inclination of the nozzle rows 31 is corrected by the amount of displacement S, the displacement of the drop positions in the outward and homeward movements of the carriage 10 is caused only by the velocity component of the movement of the carriage 10 and is not the inclination. Therefore, by shifting the ink discharge timing between the outward and homeward movements as in the related art, the displacement of the drop positions caused only by the velocity component of the movement of the carriage 10 is eliminated.

Setting Amounts of Correction at a Plurality of Positions in Direction of Movement of Carriage There is a case where the inclination of the nozzle rows with respect to the transport direction A of the paper P varies depending on the position of the input apparatus 10 in terms of the direction of movement of the 10 due to the deflection of the carriage guide shaft 17 as a supporting shaft of the carriage 10 and the deflection of the supporting frame 4. In this case, one amount of correction can hardly accommodate the entire range of movement of the carriage 10. In this case, by setting the amounts of correction respectively for the plurality of positions in the direction of movement of the carriage 10, the problem of the change of the inclination of the nozzle rows 31 depending on the difference of the positions in the direction of movement of the carriage 10 is eliminated, so that the displacement of the ink drop positions is prevented. The setting of the amounts of correction in this case is achieved by executing the processes from (a) to (c) described above respectively for the plurality of positions in the direction of movement of the carriage 10.

Second Embodiment

For First to Sixth Causes of the Inclination of the Vertical Rule Mark

Referring now to FIGS. 5 to 7, a second embodiment will be described. In the second embodiment, the control unit 37 is configured to control the displacement of the ink drop positions caused by the difference of the ink discharge velocities (for example, Vn1, Vn2, and Vn3) and the ink drop distances (for example, H1, H2, and H3) depending on the discharge positions (for example, d, e, and f) of ink discharged from the nozzles 30 of the printhead 13 shown in FIGS. 9 to 14 in terms of the transport direction A of the paper P to be corrected by differentiating the timings of starting operation of the first drive unit 33 and the second drive unit 34.

In other words, the control unit 37 stores amounts of correction for correcting the displacement of the ink drop positions between the upstream side nozzles 30 and the downstream side nozzles 30 of the nozzle rows 31 of the printhead 13 in association with the movement of the carriage 10 when driving the first drive unit 33 and the second drive unit 34 in a storage unit thereof. The displacement of the ink drop positions caused by the difference of the ink discharge velocities Vn1, Vn2, and Vn3, or the ink drop distances H1, H2, and H3 results in the inclinations in the opposite direction in the outward and homeward movements of the carriage 10, and the extent of the "displacement" varies depending on the ink discharge modes in which the carriage movement velocity or the ink drop diameter is different from each other. Therefore, the amounts of correction, the method of setting of which will be described later, are set individually for the outward and homeward movements of the carriage 10 and for the ink discharge modes (relative driving conditions between the first drive unit 33 and the second drive unit 34), and are amounts which differentiate the timing of operation between the first drive unit 33 and the second drive unit 34 individually.

How to Set Amounts of Correction

Hereinafter, how to set the amounts of correction will be described separately on (a) Formation of Test Pattern, (b) Measurement of the Amount of Displacement of the Drop Positions, and (c) Timing of Operation described below.

As shown in FIG. 1, the carriage 10 is waiting at the home position to be ready for the formation of the test pattern. In the waiting state, the carriage 10 is in the state of being abutment with the side frame 4R on the right side of the supporting frame 4 when viewed from the front. On the basis of the posture of the carriage 10 in this state, measurement of the amount of displacement x of the drop positions for the respective ink discharging modes, and setting of the timings of operation of the first drive unit 33 and the second drive unit 34, that is, setting of the amounts of correction are carried out.

(a) Formation of Test Pattern (see FIGS. 5 and 7)

First of all, ink is discharged from the nozzles 30 of the printhead 13 while causing the carriage 10 to travel with respect to the test paper P for the respective ink discharging modes under the conditions corresponding to the modes separately for the outward homeward movements to form the rule marks M as the test patterns for the respective modes for the outward and homeward movement respectively. The term "ink discharging mode" means a "fast" mode for printing in a short time by lowering the printing density, a "high-quality" mode for a high-quality printing by increasing the printing density, and so on, and the velocity of movement of the carriage, the size of the ink drops, and other conditions are set, respectively.

Then, the test patterns are printed on the paper P in a state in which the lateral rule mark Y is parallel to the primary scanning direction of the carriage 10 but the vertical rule mark T is inclined by the angle of inclination θ for the respective ink discharge modes. In FIG. 7, only the test pattern for the outward movement is illustrated. In the case of the test pattern in the homeward movement, the angle of inclination (−θ) in the opposite direction from that in FIG. 7 is resulted even the mode is the same.

(b) Measurement of Amount of Displacement of Drop Positions (see FIG. 7)

As shown in FIG. 7, the length of the vertical rule mark T is the same as the nozzle row length Ln. By measuring the angle of inclination θ of the vertical rule mark T, the amount of displacement x of the drop positions in the primary scanning direction B per the nozzle row length Ln on the basis of the cases from the second to sixth causes is obtained by $x=Ln\cdot\sin\theta$. The amount of displacement x of the drop positions may also be obtained by direct measurement.

(c) Setting of Timing of Operation (see FIGS. 5 and 7)

The positions where the amount of displacement x of the drop positions is actually corrected are the positions of the first supporting portion Q1 and the second supporting portion Q2. Therefore, it is necessary to convert the amount of displacement x into the amount of displacement S at the position of the first supporting portion Q1 or the position of the second supporting portion Q2.

The converted amount of displacement S has a relation of $S=x\cdot Le/Ln\cdot\cos\theta$ as shown in FIGS. 5 and 7. When the angle of inclination θ is small, the converted amount of displacement S may be obtained by $S\approx x\cdot Le/Ln$. The converted amount of displacement S corresponds to the amount of correction described above. The amounts of correction (converted amounts of correction S) are obtained for the respective ink discharge modes individually for the outward and homeward movement, and are stored in the storage unit of the control unit 37.

Therefore, for example, by causing the first drive unit 33 to move before the second drive unit 34 by the amount of $S(\approx x\cdot Le/Ln)$ respectively for the outward movement and the homeward movement, the displacement of the ink drop positions caused by the difference in the ink discharge velocities Vn1, Vn2, and Vn3, the ink drop distances H1, H2, and H3 or the like depending on the ink discharge positions d, e, and f of the ink discharged from the nozzles 30 in the printhead 13 shown in FIGS. 9 to 14 in terms of the transport direction A of the paper P is prevented.

The displacement of the drop positions between the outward and homeward movements of the carriage 10 due to only the velocity component of the movement of the carriage 10 is eliminated by shifting the ink discharge timing between the outward and homeward movements as in the related art.

Consideration of Inclination of Nozzle rows

As the amounts of correction, the inclination of the nozzle rows 31 of the printhead 13 may also be included in the cause of the displacement of the ink drop positions. The inclusion may either by the case where the amount of correction for the displacement of the drop positions caused by the inclination of the nozzle rows 31 is additionally provided and the both amounts of correction are applied in combination for each of the outward and homeward movements of the carriage 10, and for the respective liquid discharging modes, and a case where the amounts of correction are combined in advance respectively for the outward and homeward movements of the carriage 10, and for the respective liquid discharging modes and are applied as one amount of correction. Accordingly, since the inclination of the nozzle rows 31 is included in the cause of the displacement of the ink drop positions, almost all the causes of occurrence of the displacement of the ink drop positions are addressed, so that further reliable prevension of the displacement of the ink drop positions is achieved.

Setting of Amounts of Correction for a Plurality of Positions in the Direction of Movement of Carriage There is a case where the inclination of the nozzle rows 31 with respect to the transport direction A of the paper P is changed depending on the position in the direction of movement of the carriage 10 due to the deflection of the carriage guide shaft 17 as the supporting shaft of the carriage 10 or the deflection of the supporting frame 4. In this case, one amount of correction can hardly accommodate the entire range of movement of the carriage 10. In this case, by setting the amounts of correction for the plurality of positions in the direction of movement of the carriage 10, the problem of the change of the inclination of the nozzle rows 31 depending on the difference of the positions in the direction of movement of the carriage 10 is eliminated, so that the displacement of the ink drop positions is prevented. The setting of the amounts of correction in this case is achieved by executing the processes from (a) to (c) described above for the plurality of positions in terms of the direction of movement of the carriage 10, respectively.

Third Embodiment

A third embodiment is adapted to correct the displacement of the liquid drop positions which occurs automatically at the time of movement of the carriage 10 (see FIGS. 5 to 7, 8, 9 to 15).

The first position detector 35 is a member configured to detect the position of the first supporting portion Q1 provided on the side of the rear surface 40 of the carriage 10 in terms of the primary scanning direction B. The second position detector 36 is a member configured to detect the position of the second supporting portion Q2 provided on the side of the front surface 41 of the carriage 10 in terms of the primary scanning direction B. Then, the first position detector 35 and the second position detector 36 each are configured of the linear scale mechanism unit 42, and the linear scale mechanism unit 42 includes a linear scale 42*a* tensed between the left and right side frames 4L and 4R of the supporting frame 4 of the printer body 3 and an encoder 43 described above configured to detect a number of slits, not shown, formed at predetermined pitches on the linear scale 42*a*.

The operation correcting device 38 is a device configured to calculate and store the amount of positional displacement D between the first supporting portion Q1 and the second supporting portion Q2 from the positional data of the first supporting portion Q1 detected by the first position detector 35 and the positional data of the second supporting portion Q2 detected by the second position detector 36 and correct the operation of the control unit 37 on the basis of the stored amount of positional displacement D.

The liquid discharging apparatus 1 in the third embodiment includes, in addition to the control unit 37 in the first embodiment or the control unit 37 in the second embodiment, the first position detector 35, the second position detector 36, and the operation correcting device 38 configured to correct the operation of the control unit 37. The correction of operation of the control unit 37 by the operation correcting device 38 will be described below.

Correction of Operation of Control Unit by Operation Correcting Device

On the basis of the positional data of the first supporting portion Q1 detected by the first position detector 35 and the positional data of the second supporting portion Q2 detected by the second position detector 36, the amount of positional displacement D between the first supporting portion Q1 and the second supporting portion Q2 at that time point is obtained. Then, the moved position or the posture of the carriage 10 which is determined on the basis of the amount of positional displacement S preset to the control unit 37 and the moved position or the posture of the carriage 10 at the present determined on the basis of the amount of positional displacement D are compared. Then, in order to correct the operation of the control unit 37 to reduce the displacement, the timings of operation of the first drive unit 33 and the second drive unit 34 are corrected.

The correction of operation of the control unit 37 may be executed separately for the outward and homeward movements of the carriage 10 in the case of the control unit 37 corresponding to the first embodiment, and may be executed separately for the outward and homeward movements of the carriage 10 for the respective ink discharge modes in the case of the control unit 37 corresponding to the second embodiment.

The correction of operation may be executed every time when the carriage 10 is moved, or may be executed every time when the number of times of the movement of the carriage 10, which is determined in advance, reaches a predetermined number of times.

Other Embodiments

The liquid discharging apparatus and the method of preventing the displacement of the liquid drop positions in the liquid discharging apparatus in the invention are basically configured as described above. However, modifications or omissions of part of the configuration are possible without departing the scope of the invention as a matter of course.

For example, the first supporting portion Q1 and the second supporting portion Q2 may simply be provided at positions displaced in terms of the transport direction A of the paper P within the range which enable a desired angular control of the carriage 10, and are not necessarily limited to the side of the rear surface 40 and the side of the front surface 41 of the carriage 10. They may be provided at positions at intermediate positions or at positions slightly shifted in the vertical direction.

It is also possible to configure the first drive unit 33 and the second drive unit 34 with linear motors, and in this configuration, the positional detection of the first supporting portion Q1 and the second supporting portion Q2 are possible without the provision of the first position detector 35 or the second position detector 36. In addition, a real-time correction is enabled.

In addition to the printhead, the liquid discharging head includes a coloring material ejecting head used for manufacturing color filters of liquid crystal display or the like, an electrode material (conductive paste) ejecting head used for forming electrodes of organic EL displays or surface emission-type displays (FED), a biological organic substance ejecting head used for manufacturing biochips, and a sample ejecting head as a precise pipette.

What is claimed is:

1. A liquid discharging apparatus comprising:

a liquid discharging head configured to discharge liquid from nozzles in a discharged material transported in a first direction;

a carriage configured to mount the liquid discharging head and reciprocate in a second direction which intersects the first direction; and a carriage moving unit configured to reciprocate the carriage, the carriage moving unit including a first drive unit and a second drive unit operating independently from each other, wherein a first supporting portion of the first drive unit with respect to the carriage and a second supporting portion of the second driving unit with respect to the carriage are located at positions displaced in the first direction, wherein a first position detector configured to detect the position of the first supporting portion in the direction of movement of the carriage, and a second position detector configured to detect the position of the second supporting portion in the direction of movement of the carriage are provided.

2. The liquid discharging apparatus according to claim 1, wherein the first supporting portion is provided at a position on the side of a rear surface of the carriage, which corresponds to the upstream side in the direction of transport of the discharged material, and the second supporting portion is provided at a position on the side of a front surface of the carriage.

3. The liquid discharging apparatus according to claim 2, comprising a control unit configured to control driving of the first drive unit, the second drive unit, and the liquid discharge head, wherein the control unit controls relative driving conditions between the first drive unit and the second drive unit on the basis of amounts of correction for correcting the displacement of the liquid drop positions between the upstream side nozzles and the downstream side nozzles of the nozzle rows of the liquid discharging head in terms of the second direction in association with the movement of the carriage at the time of the driving.

4. The liquid discharging apparatus according to claim 3, wherein the amounts of correction are set individually for outward and homeward movements of the carriage.

5. The liquid discharging apparatus according to claim 4, wherein the amounts of correction are amounts for differentiating the timing of operation between the first drive unit and the second drive unit.

6. The liquid discharging apparatus according to claim 4, wherein the amounts of correction is set for each of a plurality of positions in the direction of movement of the carriage.

7. The liquid discharging apparatus according to claim 3, wherein the control unit is adapted to activate the first drive unit and the second drive unit to change the posture of the carriage by the amounts of correction in an initial stage when the carriage is started to be driven from the waiting posture by the first drive unit and the second drive unit, and drive the carriage while maintaining the posture after the change.

8. The liquid discharging apparatus according to claim 1, comprising an operation correcting unit configured to obtain the amount of positional displacement between the first supporting portion and the second supporting portion from positional data of the first supporting portion detected by the first position detector and positional data of the second supporting portion detected by the second position detector and correct the operation of the control unit on the basis of the obtained amount of the positional displacement.

* * * * *